US011336992B2

(12) United States Patent
Peace et al.

(10) Patent No.: US 11,336,992 B2
(45) **Date of Patent: *May 17, 2022**

(54) TWO-WAY LOUDSPEAKER WITH FLOATING WAVEGUIDE

(71) Applicant: HARMAN INTERNATIONAL INDUSTRIES, INCORPORATED, Stamford, CT (US)

(72) Inventors: Paul Wayne Peace, Viejo, CA (US); Derrick Rodgers, Altadena, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 51 days.

This patent is subject to a terminal disclaimer.

(21) Appl. No.: 16/835,998

(22) Filed: Mar. 31, 2020

(65) Prior Publication Data

US 2020/0236459 A1 Jul. 23, 2020

Related U.S. Application Data

(63) Continuation of application No. 16/069,797, filed as application No. PCT/US2017/013650 on Jan. 16, 2017, now Pat. No. 10,638,216.

(Continued)

(51) Int. Cl.

| | |
|---|---|
| ***H04R 1/24*** | (2006.01) |
| ***H04R 1/34*** | (2006.01) |
| ***H04R 5/02*** | (2006.01) |
| ***H04R 1/02*** | (2006.01) |
| ***H04R 1/22*** | (2006.01) |

(Continued)

(52) U.S. Cl.

CPC ..... *H04R 1/24* (2013.01); *H04R 1/025* (2013.01); *H04R 1/22* (2013.01); *H04R 1/2857* (2013.01); *H04R 1/345* (2013.01); *H04R 3/04* (2013.01); *H04R 5/02* (2013.01); *H04R 9/063* (2013.01); *H04R 2201/405* (2013.01)

(58) Field of Classification Search

CPC . H04R 1/22; H04R 1/24; H04R 1/025; H04R 1/2857; H04R 1/345; H04R 3/04; H04R 5/02; H04R 1/26

USPC ..... 381/98, 335, 304

See application file for complete search history.

(56) References Cited

U.S. PATENT DOCUMENTS 4,122,315 A * 10/1978 Schroeder ..... H04R 1/24 181/147

5,844,176 A 12/1998 Clark (Continued)

FOREIGN PATENT DOCUMENTS

CN 1235688 A 11/1999

CN 1324556 A 11/2001

(Continued)

*Primary Examiner* — Disler Paul

(74) *Attorney, Agent, or Firm* — Brooks Kushman P.C.

(57) ABSTRACT

One or more embodiments of the present disclosure relate to a two-way loudspeaker design that forces a condensed geometry between low frequency (LF) and high frequency (HF) drivers and then "floats" a midrange waveguide in front of the LF driver. This is a hybrid design meant to benefit from the close proximity of acoustic centers without introducing a central axis obstruction for the LF driver. In addition, the LF and HF waveguides and associated acoustic elements are used to redirect very low frequency energy not supported adequately by the LF waveguide to exit freely using other paths.

18 Claims, 4 Drawing Sheets

Related U.S. Application Data

(60) Provisional application No. 62/278,952, filed on Jan. 14, 2016, provisional application No. 62/278,959, filed on Jan. 14, 2016.

(51) Int. Cl.

| | |
|---|---|
| ***H04R 3/04*** | (2006.01) |
| ***H04R 9/06*** | (2006.01) |
| ***H04R 1/28*** | (2006.01) |

(56) References Cited

U.S. PATENT DOCUMENTS

| | | | | |
|---|---|---|---|---|
| 6,257,365 | B1 | 7/2001 | Hulsebus, II | |
| 6,981,570 | B2 * | 1/2006 | Dalbec | G10K 11/025 181/152 |
| 7,010,138 | B1 | 3/2006 | Harris et al. | |
| 7,136,498 | B1 | 11/2006 | Schott | |
| 7,513,332 | B2 | 4/2009 | Moore | |
| 7,735,599 | B2 | 6/2010 | Kubota | |
| 7,751,581 | B2 * | 7/2010 | Heil | H04R 1/345 381/337 |
| 8,995,697 | B2 | 3/2015 | Gladwin et al. | |
| 9,084,056 | B2 | 7/2015 | Flavignard et al. | |
| 9,204,212 | B2 | 12/2015 | Adams | |
| 2002/0011379 | A1 * | 1/2002 | Taylor | H04R 1/345 181/155 |
| 2003/0053644 | A1 * | 3/2003 | Vandersteen | H04R 1/26 381/182 |
| 2004/0042627 | A1 | 3/2004 | Ryan et al. | |
| 2004/0125969 | A1 * | 7/2004 | Kieltyka | H04R 1/26 381/182 |
| 2004/0252856 | A1 | 12/2004 | Masuda | |
| 2005/0217927 | A1 | 10/2005 | Noselli et al. | |
| 2006/0285712 | A1 | 12/2006 | Butler | |
| 2007/0086615 | A1 | 4/2007 | Cheney | |
| 2009/0310808 | A1 | 12/2009 | Button et al. | |
| 2010/0254558 | A1 | 10/2010 | Meyer et al. | |
| 2011/0019862 | A1 | 1/2011 | Smith et al. | |
| 2011/0085692 | A1 | 4/2011 | Voishvillo | |
| 2012/0140971 | A1 | 6/2012 | Clements | |
| 2013/0058518 | A1 | 3/2013 | Held | |
| 2014/0105426 | A1 | 4/2014 | Fincham | |
| 2015/0063621 | A1 | 3/2015 | Lilley, Jr. | |
| 2015/0365758 | A1 | 12/2015 | Bridge | |
| 2016/0119711 | A1 | 4/2016 | DeLay et al. | |
| 2017/0289684 | A1 | 10/2017 | Chang et al. | |
| 2017/0347191 | A1 | 11/2017 | Button | |
| 2018/0262836 | A1 | 9/2018 | Janes | |

FOREIGN PATENT DOCUMENTS

| | | | |
|---|---|---|---|
| CN | 1575031 | A | 2/2005 |
| CN | 1666566 | A | 9/2005 |
| CN | 1765148 | A | 4/2006 |
| CN | 204145714 | U | 2/2015 |
| CN | 104837090 | A | 8/2015 |
| CN | 204652635 | U | 9/2015 |
| JP | 2012049663 | A | 3/2012 |
| WO | 2015094115 | A1 | 6/2015 |
| WO | 2015105809 | A1 | 7/2015 |

* cited by examiner

TWO-WAY LOUDSPEAKER WITH FLOATING WAVEGUIDE

CROSS-REFERENCE TO RELATED APPLICATIONS

This application is a continuation of application Ser. No. 16/069,797, filed Jul. 12, 2018, now U.S. Pat. No. 10,638,216, issued Apr. 28, 2020, which is the U.S. national phase of PCT Application No. PCT/US2017/013650 filed on Jan. 16, 2017, which claims the benefit of U.S. provisional application Ser. No. 62/278,959 filed Jan. 14, 2016 and U.S. provisional application Ser. No. 62/278,952 filed Jan. 14, 2016, the disclosures of which are hereby incorporated in their entirety by reference herein.

TECHNICAL FIELD

The present disclosure relates to a two-way loudspeaker design having condensed geometry between high frequency and low frequency drivers, and more particularly to a two-way loudspeaker design having a floating waveguide in front of the low frequency driver.

BACKGROUND

A loudspeaker is an acoustic system that typically includes a speaker enclosure, at least one driver, and a crossover network. A loudspeaker driver is an electroacoustic transducer that converts an electrical audio signal into a corresponding sound. The dynamic loudspeaker driver is the most widely used type. When an alternating current electrical audio signal is applied to its voice coil (a coil of wire suspended in a circular gap between the poles of a permanent magnet), the voice coil is forced to move rapidly back and forth due to Faraday's law of induction, which causes a diaphragm (usually conically shaped) attached to the coil to move back and forth, pushing on the air to create sound waves.

A direct radiator loudspeaker has primarily two regions of operation—the pistonic region and the adjacent upper decade of spectrum. The pistonic region is defined as the frequency range between the mechanical resonance of the loudspeaker (i.e., the lower limit) to the spectrum region where wavelength equals the radiating surface (or diaphragm) of the loudspeaker (i.e., the upper limit). The pistonic region is the optimum region of operation for a direct radiator. The adjacent upper decade of spectrum—where wavelength is smaller than the radiating device—has efficient energy output but is flawed by mechanical cone break-up modes and erratic directivity behavior. This region, while flawed, is important in many designs and is the critical region of operation for one or more embodiments of the present disclosure.

The majority of all loudspeaker designs are simple two-way designs, which means they include two radiating elements (called drivers)—a high frequency driver (HF) and a low frequency driver (LF). This design choice is popular due to moderate cost, design simplicity, and moderate package size. This two-way arrangement is also the minimum number of elements that can reproduce the musical spectrum effectively. Within the professional loudspeaker marketplace, larger LF drivers (e.g., >10 inches) are often favored because of improved low frequency performance and overall acoustical output. In this case, the region above pistonic behavior has to be utilized.

SUMMARY

Figure 1:
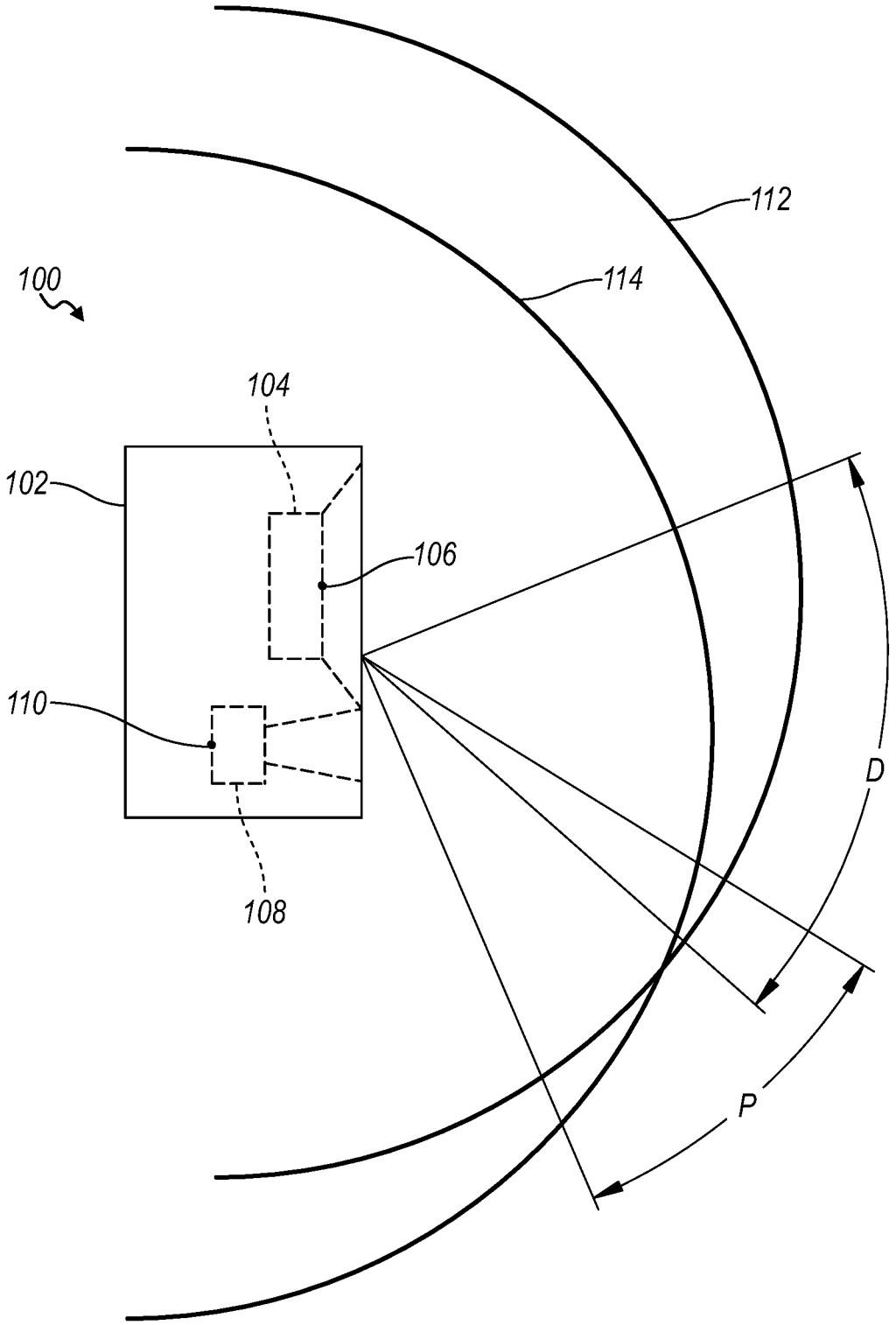
FIG. 1 illustrates a best case simplification to the actual acoustic result for conventional loudspeaker designs having typical two-way driver alignment.

One or more embodiments of the present disclosure are directed to a loudspeaker comprising a speaker enclosure, a low-frequency (LF) driver disposed in the speaker enclosure, and an LF waveguide. The LF driver may have a radiating surface adapted to emit LF acoustic energy and a radiating surface opening defined by an outer circumference of the radiating surface. The LF waveguide may define a first radiation path for LF acoustic energy. The LF waveguide may have a proximal opening positioned adjacent to the LF driver and extending away from the LF driver to a distal opening to define the first radiation path therethrough. The proximal opening may have a proximal opening area that is smaller than a radiating surface opening area to define a second radiation path for the LF acoustic energy around an outer surface of the LF waveguide.

An inner surface and an outer surface of the LF waveguide may have generally equal acoustic pressure from the LF driver. The second radiation path may exit the speaker enclosure along a front surface. The second radiation path may exit the speaker enclosure along at least one of a side surface and a rear surface. The loudspeaker may further comprise a load plate directly in front of a portion of the radiating surface and adjacent the LF waveguide to deflect LF acoustic energy along the second radiation path to a rear acoustic exit located in the rear surface.

A proximal end of the LF waveguide may not be physically connected to the LF driver. The proximal end of the LF waveguide may include a lower edge and an upper edge at least partially defining the proximal opening. The lower edge may be closer to the radiating surface opening than the upper edge. Moreover, the lower edge may be nearer a central radiation axis of the LF driver than the upper edge.

The loudspeaker may further comprise a high-frequency (HF) driver disposed in front of the radiating surface of the LF driver, at least partially obstructing the LF acoustic energy emitted by the radiating surface. A central radiation axis of the LF driver and a central radiation axis of the HF driver may be at offset angles. The HF driver may not coaxial with the LF driver.

The loudspeaker may further comprise an HF driver positioned adjacent to the LF driver, wherein a first distance between an acoustic center of the LF driver and an acoustic center of the HF driver is less than a wavelength at the crossover frequency. For instance, the first distance may be less than 5 inches. A second distance from the acoustic center of the HF driver to a central radiation axis of the LF driver is less than a radius of the radiating surface opening.

One or more additional embodiments of the present disclosure is directed to a loudspeaker comprising a speaker enclosure, an LF driver disposed in the speaker enclosure, an HF driver, and an LF waveguide. The LF driver may have a radiating surface adapted to emit LF acoustic energy and a radiating surface opening defined by an outer circumference of the radiating surface. The HF driver may be disposed in front of the radiating surface of the LF driver and at least partially obstructing the LF acoustic energy emitted by the radiating surface of the LF driver. The LF waveguide may define a first radiation path for the LF acoustic energy. The LF waveguide may have a proximal opening positioned adjacent to the LF driver and extending away from the LF driver to a distal opening to define the first radiation path therethough. The proximal opening may have a proximal opening area that is smaller than a radiating surface opening area to define a second radiation path for the LF acoustic energy around an outer surface of the LF waveguide. The distal opening of the LF waveguide may have a distal opening area that is larger than the radiating surface opening area. The proximal opening may be spaced apart from the LF driver by a distance to define an air gap between the radiating surface of the LF driver and the proximal opening of the LF waveguide.

A central radiation axis of the LF driver and a central radiation axis of the HF driver may be at offset angles. The second radiation path may exit the speaker enclosure along at least one of a side surface and a rear surface.

One or more additional embodiments of the present disclosure is directed to a loudspeaker comprising an LF driver having a radiating surface adapted to emit LF acoustic energy and an HF driver at least partially obstructing the LF acoustic energy emitted by the LF driver. The radiating surface may have a radiating surface opening defined by an outer circumference of the radiating surface. An acoustic center of the HF driver may be offset from a central radiation axis of the LF driver.

The loudspeaker may further comprise an LF waveguide defining a first radiation path for the LF acoustic energy. The LF waveguide may have a proximal opening positioned adjacent to the LF driver and extending away from the LF driver to a distal opening to define the first radiation path therethough. The proximal opening may have a proximal opening area that is smaller than a radiating surface opening area to define a second radiation path for the LF acoustic energy around an outer surface of the LF waveguide. The distal opening of the LF waveguide may have a distal opening area that is larger than the proximal opening area. The LF waveguide may be detached from the LF driver to define an air gap between the radiating surface of the LF driver and the proximal opening of the LF waveguide.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The loudspeaker operating region that includes the transition frequencies between the HF and LF drivers is called the crossover region. Performance in this region is specifically a function of the acoustic summation of the two drivers. The distance between drivers is a major contributor in determining the stable operational radiation solid angle for the crossover region. A major design goal for the crossover region is for this solid angle to match the operational radiation envelope of the individual drivers, which should also match each other. A larger driver displacement translates to a smaller crossover operational angle with erratic behavior outside this solid angle. For a professional loudspeaker, whose primary design goal is to present uniform sound coverage to a large audience area, this is non-trivial because most of the audience is in the off-axis area and the crossover region occurs in the center of the sound spectrum. The result is missing and/or distorted audible content to a large portion of the audience with the problems typically in the speech region.

One or more embodiments of the present disclosure greatly improve crossover region performance of two-way loudspeakers utilizing large LF drivers. These embodiments specifically aid in abating: (1) poor off-axis directivity in the crossover region due to displacement between drivers; (2) poor directivity from the LF driver in the region above pistonic behavior; and (3) poor LF performance due to cone break-up.

To achieve the aforementioned, a two-way loudspeaker design is provided that, in short, forces a condensed geometry between an LF driver and an HF driver and then "floats" a midrange-sized waveguide in front of the LF driver. Though this design has some similarities with coaxial designs, it is specifically not coaxial. Rather, the loudspeaker design of the present disclosure is a hybrid design meant to benefit from the close proximity of acoustic centers without introducing a central axis obstruction for the LF driver. In addition, the LF and HF waveguides and associated acoustic elements may be used to redirect very low frequency energy not supported adequately by the smaller LF waveguide to exit freely using other acoustic radiation paths. The details of this are explained in greater detail below and may include several key functional steps.

The typical and easiest placement of drivers in a loudspeaker is on a vertical line on a simple baffle. The displacement between drivers, in this case, is dependent on driver size. For two-way designs with large LF drivers, the displacement may be prohibitive to good crossover behavior. FIG. 1 is a simplified, schematic diagram of a conventional two-way loudspeaker 100. FIG. 1 illustrates a best case simplification to the actual acoustic result for conventional loudspeaker designs having typical two-way driver alignment. The diagram in FIG. 1 shows the foundation of the crossover summation equation. Specifically, FIG. 1 shows the loudspeaker 100 including a speaker enclosure 102, an LF driver 104 having an acoustic center 106, and an HF driver 108 having an acoustic center 110.

Each driver radiates acoustic energy and, if viewed instantaneously, this energy is in the form of individual pressure waves. FIG. 1 illustrates an LF energy wavefront 112 representing the acoustic energy radiated by the LF driver 104 and an HF energy wavefront 114 representing the acoustic energy radiated by the HF driver 108. Each wavefront has a propagation speed (i.e., speed of sound in air) and, therefore, has a time of flight to travel from driver to listener. For good crossover summation, the LF energy wavefront 112 and the HF energy wavefront 114 may align within ¼ wavelength.

When drivers are displaced, an included angle develops where the wavefronts are in alignment and the summation is positive. Outside this angle, summation is largely subtractive. A loudspeaker design goal is to align drivers such that a pathlength alignment angle P encompasses a directivity angle D. The pathlength alignment angle is the region where good summation will occur between HF and LF drivers (e.g., the wavefronts are within ¼ wavelength). The directivity angle D is the designed operational (i.e., coverage) angle of the loudspeaker and is based on the coverage envelopes of the individual drivers. As illustrated in FIG. 1, the directivity angle D is larger than the pathlength alignment angle P and the two only have partial overlap (i.e., the drivers 104 and 108 are out of alignment within most of the design operational angle).

As stated above, FIG. 1 is a best case simplification to the actual acoustic result. First, there is a 3 dB differential between coherence and ¼ wavelength summation (i.e., there is 3 dB variance within the pathlength alignment angle). Second, the actual phase waves of the drivers are much more complex (and frequency dependent) than the simple equal pathlength circles, representing the energy wavefronts 112, 114, drawn from the acoustic centers 106, 110 in FIG. 1. The diagram in FIG. 1 shows the foundation of the summation equation, but the actual pathlength alignment angle P will always be smaller than shown.

There are several design manipulations—all with corresponding design penalties—that can center the pathlength alignment angle P inside the directivity angle D. These design manipulations may be helpful, but do not enlarge the pathlength alignment angle P. In order to expand the pathlength alignment angle P, the HF and LF acoustic centers may be brought closer together and the phase wave of each driver may be made similar in shape.

Figure 2:
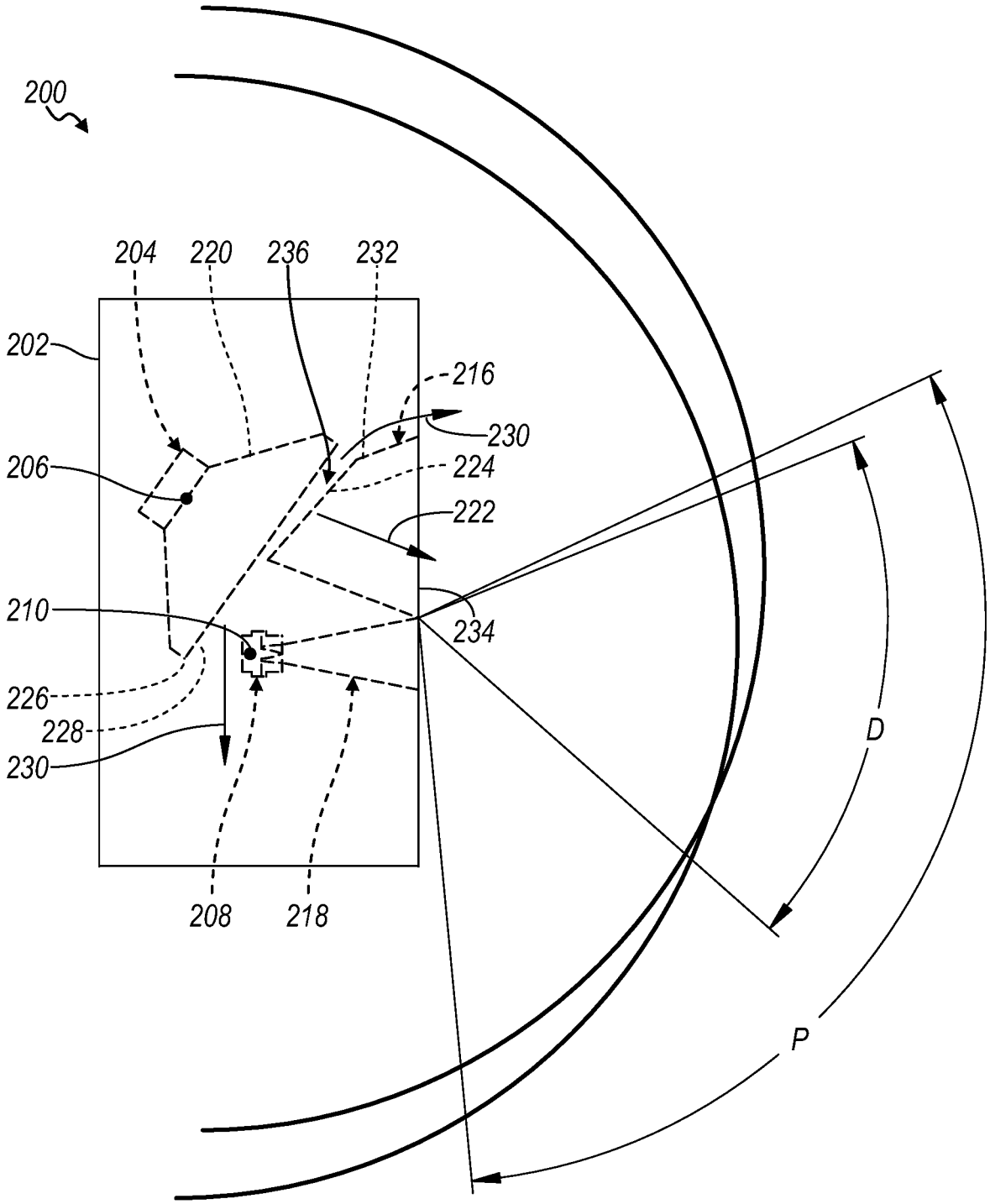
FIG. 2 illustrates a best case simplification to the actual acoustic result for a loudspeaker design having a condensed two-way driver alignment geometry, according to one or more embodiments of the present disclosure.

The loudspeaker design of the present disclosure may utilize a condensed geometry between the HF and LF drivers. This can be accomplished in numerous ways, including use of phase plugs. According to one or more embodiments, the loudspeaker design may utilize geometry similar to the one shown in FIG. 2. FIG. 2 is a simplified, exemplary schematic diagram of a loudspeaker 200, according to one or more embodiments of the present disclosure. Specifically, FIG. 2 illustrates a best case simplification to the actual acoustic result for a loudspeaker design having condensed two-way driver alignment geometry, in accordance with one or more embodiments of the present disclosure. As in FIG. 1, the loudspeaker 200 illustrated in FIG. 2 may include a speaker enclosure 202, an LF driver 204 having an acoustic center 206, and an HF driver 209 having an acoustic center 210. The HF driver 208 may be positioned adjacent to the LF driver 204 such that a distance between the acoustic center 206 of the LF driver 204 and the acoustic center 210 of the HF driver 208 is less than a wavelength at a crossover frequency. As an example, the distance between the acoustic centers may be less than 5 inches.

As shown, by utilizing this condensed geometry between the acoustic centers 206, 210 of the LF and HF drivers 204, 208, the directivity angle D is well within the pathlength alignment angle P (i.e., the LF and HF drivers 204, 208 are completely aligned within the designed operational angle). Similar to FIG. 1, FIG. 2 illustrates an LF energy wavefront 212 representing the acoustic energy radiated by the LF driver 204 and an HF energy wavefront 214 representing the acoustic energy radiated by the HF driver 208. Further, both the LF driver 204 and the HF driver 208 may be coupled to an LF waveguide 216 and an HF waveguide 218, respectively, at the crossover region. Consequently, the LF energy wavefront 212 and the HF energy wavefront 214 will be more similar in shape.

The LF driver 204 may include a radiating surface 220, sometimes referred to as a cone or diaphragm, adapted to emit LF acoustic energy. The radiating surface 220 moves like a piston to pump air and create sound waves in response to electrical audio signals. As a result of the condensed geometry illustrated in FIG. 2, the LF driver 204 is no longer a simple direct radiator. It now has acoustical obstructions in the form of the HF driver 208 near the LF driver's radiating surface 220 that impedes the crossover region frequencies. For instance, the HF driver 208 may be disposed in front of the radiating surface 220 of the LF driver 204 such that it at least partially obstructs the LF acoustic energy emitted by the radiating surface.

In order to achieve a condensed geometry while maintaining good acoustic behavior from the LF driver 204 at all operating frequencies, the loudspeaker design may employ an LF waveguide 216 that is smaller than a traditional low frequency waveguide. The LF waveguide 216 defines a first radiation path 222 for the LF acoustic energy. The size of the LF waveguide 216 may be carefully chosen to mate with the HF waveguide 218 so that it may align to the HF waveguide. In this manner, the two waveguide may share similar directivity properties and length to present acoustic alignment between their corresponding drivers at the target operational angle.

Further, to mitigate the effects of cone breakup and narrowing directivity, the LF waveguide 216 may include a proximal opening 224 positioned adjacent to the LF driver 204 (coupling to the driver) that may be considerably smaller than the radiating surface 220 of the LF driver 204. An outer circumference 226 of the radiating surface 220 may define a radiating surface opening 228 having a radiating surface opening area. Likewise, the proximal opening 224 of the LF waveguide 216 may define a proximal opening area. Accordingly, the proximal opening area may be smaller than the radiating surface opening area. Because the proximal opening area may be smaller than the radiating surface opening area, this defines a second radiation path 230 for the LF acoustic energy around an outer surface 232 of the LF waveguide 216.

The LF waveguide 216 may extend away from the LF driver 204 to a distal opening 234 (coupling to free air) defining the first radiation path 222 therethrough. The distal opening 234 may define a distal opening area and be sized appropriate to waveguide design practice, as understood by one of ordinary skill in the art, and to support the directivity criteria. For instance, the distal opening area may be larger than the proximal opening area. In general, the larger the distal opening 234, the more control on directivity.

According to one or more embodiments, the design specifics for the LF waveguide 216 may include at least two criteria: (1) the distal opening area of the LF waveguide 216 may be larger than the radiating surface opening area; and (2) the LF waveguide length and shape may be strategically chosen to mate with the HF waveguide 218 to maintain proper phase wave relationships. The remaining design specifics for the LF waveguide 216 can vary.

Typical LF waveguide design follows two methods. The first method is intended to support low frequencies. In this case, the waveguide couples to the entire LF radiating surface, typically by a physical, sealed connection to the LF driver's rim, and must be large enough to support lower frequencies. The second method is intended to support the midrange frequencies and follows compression driver techniques (i.e., the driver fires into a compression chamber—with or without a phase plug—and then couples to the waveguide). This can significantly improve the high frequency performance but may greatly diminish low frequency performance because the effective radiating surface is diminished and the compression chamber can introduce new acoustic elements in the system such as resistance, mass and compliance depending on the geometry of the design.

As explained above, a condensed geometry between the LF driver 204 and the HF driver 208 may be a primary design motivation. As further explained above, a smaller LF waveguide 216 may be a means to mitigate poor driver behavior in the crossover region. According to one or more additional embodiments, the LF waveguide 216 may float in front of the LF driver 204. A floating waveguide is not physically connected to its corresponding driver, but rather is detached from the LF driver. As illustrated in FIG. 2, the proximal opening 224 of the LF waveguide 216 may be spaced apart from the LF driver 204 by a distance to define an air gap 236 between the LF driver 204 and the LF waveguide 216. The air gap 236 may exist at least in part because the proximal opening area of the LF waveguide 216 may be smaller than the radiating surface opening area of the LF driver 204. Because the radiating surface 220 moves in response to electrical audio signals, the distance between the LF driver 204 and the LF waveguide 216—and, correspondingly, the size of the air gap 236—may vary.

By allowing the LF waveguide 216 to float may provide a means to effectively extract the higher frequencies from the radiating surface 220 of the LF driver 204 directly into the LF waveguide 216 (designed to support these frequencies) via the first radiation path 222 without the use of a compression chamber and without forcing all acoustical energy into the LF waveguide 216. Accordingly, frequencies not optimum for the LF waveguide 216 may be allowed a different radiation path, such as the second radiation path 230. Several paths may be necessary for good performance. Thus, the second radiation path 230 may comprise several radiation paths. These additional radiation paths may be created using numerous acoustical elements and are primarily formed to address different frequency regions.

Figure 3:
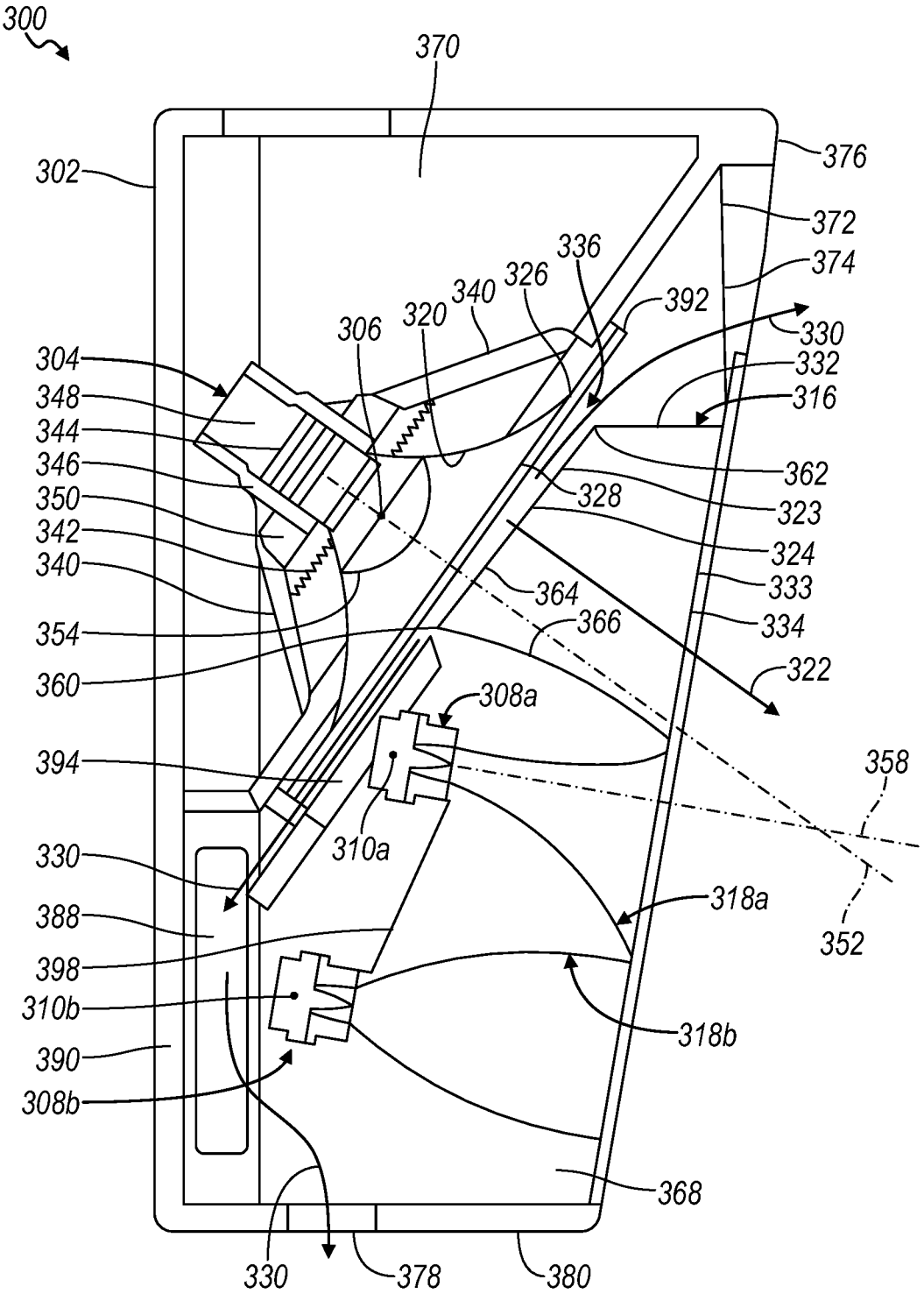
FIG. 3 is an exemplary side cross-sectional view of a loudspeaker, according to one or more embodiments of the present disclosure.
Figure 4:
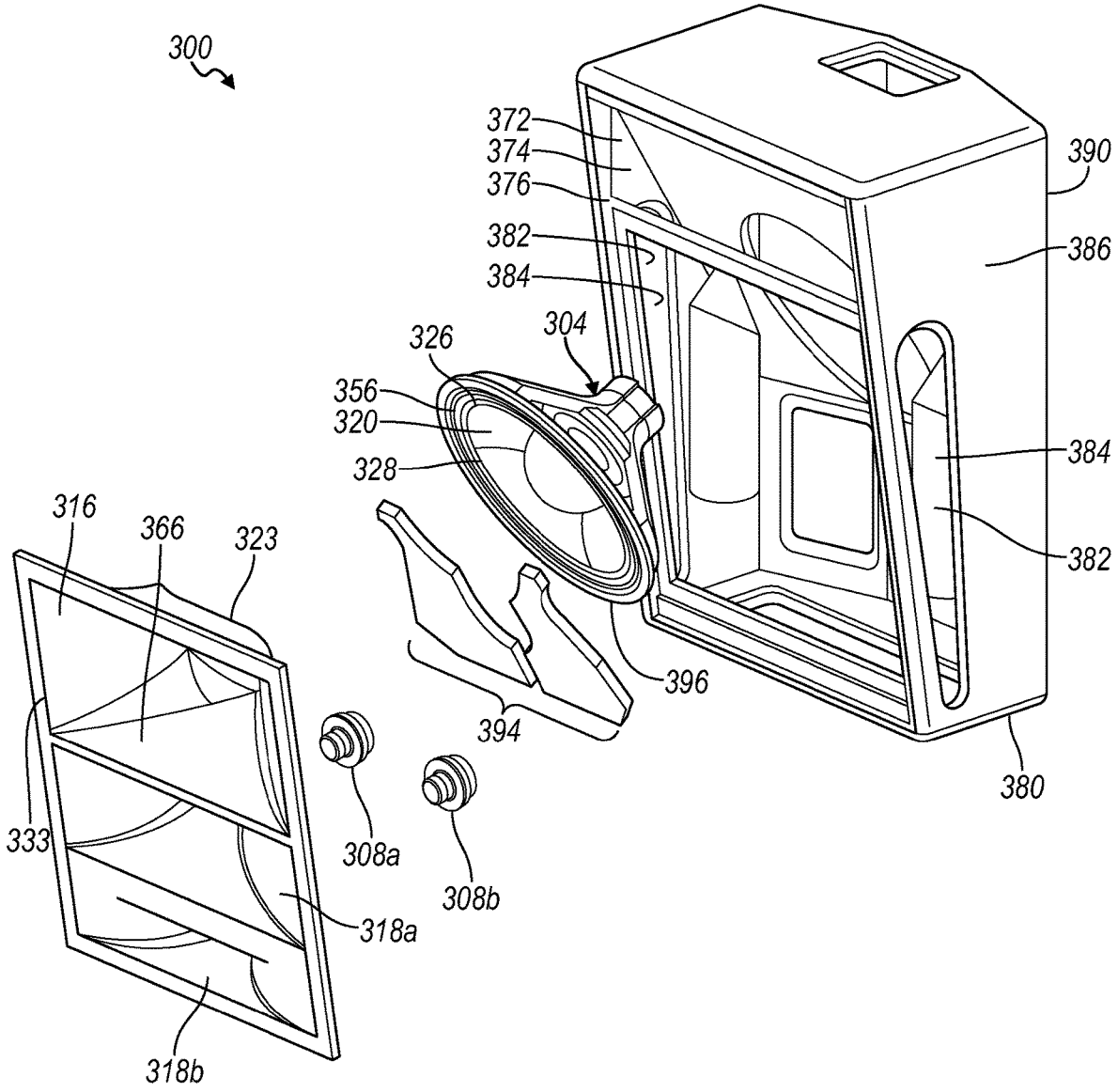
FIG. 4 is an exemplary, exploded view of the loudspeaker described in FIG. 3, according to one or more embodiments of the present disclosure.

FIG. 3 is an exemplary side cross-sectional view of a loudspeaker 300 employing the various design criteria described above, according to one or more embodiments of the present disclosure. FIG. 4 is an exemplary, exploded view of the loudspeaker 300 described in FIG. 3. The loudspeaker 300 may include a speaker enclosure 302, an LF driver 304 having an acoustic center 306, and at least one HF driver 308 having an acoustic center 310. As shown, the at least one HF driver 308 may include a first HF driver **308*a* having an acoustic center 310*a* and a second HF driver 308*b* having an acoustic center 310*b*. The second HF driver 308*b* may be spaced farther apart from the LF driver 304 than the first HF driver 308*a***. However, the two-way loudspeaker design according to the present disclosure may be employed using only a single HF driver.

The LF driver may include a radiating surface 320 (or cone) connected to a rigid basket, or frame 340, via a flexible suspension component, commonly called a spider 342. The spider 342 may constrain a voice coil 344 to move axially through a cylindrical magnetic gap 346. The voice coil 344 may be wound around a former 348, which serves as a heat-resistant spool for the wire. When an electrical audio signal is applied to the voice coil 344, a magnetic field is created by the electric current in the voice coil, making it a variable electromagnet. The LF driver 304 may further include a magnet 350, held in place by the frame 340, which surrounds at least a portion of the voice coil 344 and former 348. The magnet 350 creates a standing magnetic field to oppose the variable electromagnetic field of the voice coil 344. The voice coil 344 and the LF driver's magnetic system interact, generating a mechanical force that causes the voice coil 344 and, thus, the attached radiating surface 320 to move back and forth along a first central radiation axis 352 of the LF driver 304 like a piston to pump air and create sound waves in response to the electrical audio signals.

A dust cap 354 may cover a hole in the center of the radiating surface 320. The dust cap 354 may reduce the amount of dust and dirt that can get into the gap of the magnet 350, reduce leakage losses through the LF driver 304, and add strength to the radiating surface 320 while helping to maintain its shape. A flexible suspension system may include the spider 342 and a surround 356 (see FIG. 4). The surround 356 may be attached to both an outer circumference 326 of the radiating surface 320 and the frame 340. The suspension system may center the voice coil 344 in the magnetic gap 346 and exert a restoring force to keep it there, essentially acting like a spring when the driver is in motion. The spider 342 may provide the majority of the restoring force, while the surround 456 may help to center the voice coil 344 and radiating surface 320 to allow free pistonic motion aligned with the magnetic gap 346. The surround 356, while helping to limit the maximum mechanical excursion of the radiating surface 320 and voice coil 344, may also determine how energy traveling through the radiating surface 320 is absorbed. The mass of the moving parts (the radiating surface 320, the dust cap 354, the voice coil 344 and the former) and the compliance of the suspension (the surround 356 and the spider 342) control the resonance ($F_s$) of the LF driver, which in turn controls its low-frequency response.

As described in FIG. 2, the outer circumference 326 of the radiating surface 320 may define a radiating surface opening having a radiating surface opening area. Like the illustration in FIG. 2, the LF driver 304 and the first HF driver **308*a* may have a condensed geometry such that the first HF driver 308*a* at least partially obstructs the LF driver 304. For instance, the first HF driver 308*a* may be disposed in front of the radiating surface 320 of the LF driver 304, though the first HF driver may not be coaxial with the LF driver 304. Rather, the acoustic center 310*a* of the first HF driver 308*a* may be offset from the first central radiation axis 352. Similar to FIG. 2, the first HF driver 308*a* may be positioned adjacent to the LF driver 304 such that a first distance between the acoustic center 306 of the LF driver 304 and the acoustic center 310*a* of the first HF driver 308*a* is less than a wavelength at the crossover frequency. As an example, the distance between the acoustic centers may be less than 5 inches. According to one or more embodiments, a second distance orthogonal to the first central radiation axis 352 from the acoustic center 310*a* of the first HF driver 308*a* may be less than a radius of the radiating surface opening 328**.

The first HF driver **308*a* may be physically coupled to a first HF waveguide 318*a* while the second HF driver 308*b* may be physically coupled to a second HF waveguide 318*b*. The first HF driver 308*a* may emit HF acoustic energy along a second central radiation axis 358. According to one or more embodiments of the present disclosure, the first central radiation axis 352 (corresponding to the LF driver 304) and the second central radiation axis 358 (corresponding to the first HF driver 308*a*) may be at offset angles. The LF driver 304 may be coupled to an LF waveguide 316 that is smaller than a traditional low frequency waveguide. The LF waveguide 316 defines a first radiation path 322 for the LF acoustic energy. The size of the LF waveguide 316 may be carefully chosen to mate with the first HF waveguide 318*a*** so that it may align to the first HF waveguide. In this manner, the two waveguide may share similar directivity properties and length to present acoustic alignment between their corresponding drivers at the target operational angle.

The LF waveguide 316 may include a proximal end 323 having a proximal opening 324 positioned adjacent to the LF driver 304 that may be considerably smaller than the radiating surface opening 328 of the LF driver 304. The proximal opening 324 of the LF waveguide 316 may define a proximal opening area. Accordingly, the proximal opening area may be smaller than the radiating surface opening area. Because the proximal opening area may be smaller than the radiating surface opening area, this defines a second radiation path 330 for the LF acoustic energy around an outer surface 332 of the LF waveguide 316. The LF waveguide 316 may extend away from the LF driver 304 to a distal end 333 having a distal opening 334 defining the first radiation path 322 therethrough. The distal opening 334 may define a distal opening area that may be larger than the proximal opening area.

Similar to FIG. 2, the LF waveguide 316 may float in front of the LF driver 304 such that the proximal end 323 is not physically connected to the LF driver, but rather is detached from the LF driver 304. The proximal opening 324 of the LF waveguide 316 may be spaced apart from the LF driver 304 by a distance to define an air gap 336 between the LF driver 304 and the LF waveguide 316. The air gap 336 may exist at least in part because the proximal opening area of the LF waveguide 316 may be smaller than the radiating surface opening area of the LF driver 304. Because the radiating surface 320 moves in response to electrical audio signals, the distance between the LF driver 304 and the LF waveguide 316—and, correspondingly, the size of the air gap—may vary.

According to one or more embodiments, the proximal opening 324 of the LF waveguide 316 may be circular. To this end, the proximal end 323 may include a lower edge 360 and an upper edge 362. The lower edge 360 may be nearer the central radiation axis 352 of the LF driver 304 than the upper edge 362. Further, the lower edge 360 may be closer to the radiating surface opening 328 than the upper edge 362. In this manner, the proximal opening 324 may be a constant distance from the radiation surface 320.

According to one or more alternative embodiments, the proximal opening 324 of the LF waveguide 316 may be rectangular. To this end, the lower edge 360 may be a first horizontal edge and the upper edge 362 may be a second horizontal edge opposite the first horizontal edge. Further, the proximal end may include two vertical edges 364 that, along with the first and second horizontal edges, define the proximal opening 324. Similar to above, the first horizontal edge may be nearer the central radiation axis 352 of the LF driver 304 than the second horizontal edge. Further, the first horizontal edge may be closer to the radiating surface opening 328 than the second horizontal edge.

Allowing the LF waveguide 316 to float may provide a means to effectively extract the higher frequencies from the radiating surface 320 of the LF driver 304 directly into the LF waveguide 316 (designed to support these frequencies) via the first radiation path 322 without the use of a compression chamber and without forcing all frequencies into the LF waveguide. Accordingly, frequencies not optimum for the LF waveguide 316 may be allowed a different radiation path, such as the second radiation path 330. Moreover, due to the multiple radiation paths, an inner surface 366 and the outer surface 332 of the LF waveguide 316 may have generally equal acoustic pressure from the LF driver 304. As previously described, several paths may be necessary for good performance. Thus, the second radiation path 330 may comprise several radiation paths. These additional radiation paths may be created using numerous acoustical elements and are primarily formed to address different frequency regions, as will be discussed below.

The loudspeaker 300 may include two internal chambers—a front chamber 368 and a rear chamber 370. The rear chamber 370 may house the LF driver 304 in a vented box design. The front chamber 368 may be formed by enclosing the space directly in front of the LF driver 304 and behind the LF and HF waveguides 316, 318. According to one or more embodiments, the front chamber 368 may include seven (7) exit paths for the LF acoustic energy. A primary exit may be the LF waveguide 316 itself, which may be a critical exit for the crossover frequencies via the first radiation path 322. Other acoustic exits in the loudspeaker 300 may include: a front acoustic exit 372 defined by a front opening 374 in a front surface 376 of the speaker enclosure 302 directly above the LF driver 304; a bottom acoustic exit 378 at a bottom surface 380 of the speaker enclosure 302; two side acoustic exits 382 defined by slender openings 384 in side surfaces 386 of the speaker enclosure 302 (see FIG. 4); and two rear acoustic exits 388 in a rear surface 390 of the speaker enclosure 302.

As previously described, the proximal opening 324 of the LF waveguide 316 may be smaller than the radiating surface opening 328 of the LF driver 304. Floating the LF waveguide 316 may force only a portion of the LF acoustic energy from the LF driver 304 into the LF waveguide 316 via the first radiation path 322. Rather, the LF acoustic energy may be divided between the LF waveguide 316 via the first radiation path 322 and the other acoustic exits discussed above via the second radiation path 330. The LF acoustic energy may follow the path of least resistance. The loudspeaker design according to the present disclosure utilizes this property to optimize performance. Placement of the proximal opening of the LF waveguide 316 near the center of the radiating surface 320, creating a close coupling to the voice coil 344, may promote the higher crossover frequencies to enter the LF waveguide 316.

Crossover frequencies that are generated by outer portions of the radiating surface 320 are, in general, the LF acoustic energy that produces the erratic behavior outside the pistonic region of operation. The second radiation path presents itself as an acoustical low pass filter and restricts this specific LF acoustic energy from exiting other paths. The use of extensive absorption treatment (not shown) inside the front chamber 368 and dividing the LF acoustic energy radiating from an outer rim 392 of the LF driver 304 into different paths is important in this regard. Thus, the floating LF waveguide 316 may create an acoustic filter for mid-range frequencies that come off the rim 392. The front chamber 368 may absorb the mid-range frequencies from the rim. Meanwhile, mid-range frequencies from a center of the LF driver 304 may exit through the LF waveguide 316.

The use of multiple exit paths now requires the LF energy from these paths to acoustically sum back together at the listener. The same ¼ wavelength alignment requirement is true for this energy as it was described for the crossover energy. Thus, each secondary exit will have a pathlength requirement and a frequency dependency critical to this alignment.

The frequency region just below the effective operation of the LF waveguide 316 can be difficult to maintain in the design. These wavelengths may be small enough to be greatly affected by the obstructions in the front chamber 368 and may also have difficulty aligning to the LF waveguide energy. Three exits may be primary for these frequencies that are just below the effective operation of the LF waveguide 316. They may include the front opening 374 directly above the LF waveguide 316 and the two side acoustic exits 382 on the side surfaces 386 of the loudspeaker (FIG. 4). The front acoustic exit 372 may provide a very direct radiation path out for the LF acoustic energy on upper edges of the radiating surface 320. This exit meets the ¼ wavelength requirement for all frequencies produced by the LF driver 304. The slender side acoustic exits 382 may be very specific to a small portion of LF acoustic energy from the left and right rim portions of the radiating surface 320.

According to one or more embodiments, the loudspeaker 300 may include a load plate 394 disposed in front of a portion of the radiating surface 320, such as a bottom portion 396. Accordingly, the load plate 394 may be disposed adjacent to the proximal end 323 of the LF waveguide 316. In this manner, along with the first HF driver 308*a*, the load plate 394 may obstruct a portion of the LF acoustic energy emitted by the LF driver 304. The load plate 394 may accomplish several functions. For instance, the load plate 394 may provide a safe landing for acoustical treatment between the waveguides 316, 318 and the LF driver 304 critical to suppressing crossover energy trapped in the front chamber 368. The load plate 394 may also prevent LF acoustic energy from directly pressurizing a rear surface 398 of the waveguides 316, 318. The load plate 394 may provide a direct radiation path out of the front chamber 368 and to the rear acoustic exits 388 by deflecting LF acoustic energy from the bottom portion 396 of the radiating surface 320 of the LF driver 304. The design may allow rear chamber vents to radiate into the front chamber 368. Alternatively, the rear chamber vents may radiate directly into free air.

According to one or more embodiments, a front chamber is not a necessity, but may be very useful. Rim energy from the radiating surface 320 may be broken into separate paths and not allowed identical symmetric paths back into free air. Crossover energy from the rim should be largely absorbed.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker comprising:

a speaker enclosure;

a low-frequency (LF) driver disposed in the speaker enclosure and having a radiating surface adapted to emit LF acoustic energy and a radiating surface opening defined by an outer circumference of the radiating surface;

an LF waveguide defining a first radiation path for LF acoustic energy, the LF waveguide having a proximal opening positioned adjacent to the LF driver and extending away from the LF driver to a distal opening to define the first radiation path therethough, the proximal opening having a proximal opening area that is smaller than a radiating surface opening area to define a second radiation path for the LF acoustic energy around an outer surface of the LF waveguide; and a high-frequency (HF) driver positioned adjacent to the LF driver, wherein a first distance between an acoustic center of the LF driver and an acoustic center of the HF driver is less than a wavelength at a crossover frequency.

2. The loudspeaker of claim 1, wherein the distal opening of the LF waveguide has a distal opening area that is larger than the radiating surface opening area.

3. The loudspeaker of claim 1, wherein the LF waveguide is detached from the LF driver to define an air gap between the radiating surface of the LF driver and the proximal opening of the LF waveguide.

4. The loudspeaker of claim 1, wherein an inner surface and an outer surface of the LF waveguide have generally equal acoustic pressure from the LF driver.

5. The loudspeaker of claim 1, wherein the second radiation path exits the speaker enclosure along a front surface.

6. The loudspeaker of claim 1, wherein the second radiation path exits the speaker enclosure along at least one of a side surface and a rear surface.

7. The loudspeaker of claim 6, further comprising a load plate directly in front of a portion of the radiating surface and adjacent the LF waveguide to deflect LF acoustic energy along the second radiation path to a rear acoustic exit located in the rear surface.

8. The loudspeaker of claim 1, wherein a proximal end of the LF waveguide is not physically connected to the LF driver.

9. The loudspeaker of claim 8, wherein the proximal end of the LF waveguide includes a lower edge and an upper edge at least partially defining the proximal opening, wherein the lower edge is closer to the radiating surface opening than the upper edge.

10. The loudspeaker of claim 9, wherein the lower edge is nearer a central radiation axis of the LF driver than the upper edge.

11. The loudspeaker of claim 1, wherein the first distance is less than 5 inches.

12. The loudspeaker of claim 1, wherein a second distance from the acoustic center of the HF driver to a central radiation axis of the LF driver is less than a radius of the radiating surface opening.

13. A loudspeaker comprising:

a speaker enclosure;

a low-frequency (LF) driver disposed in the speaker enclosure and having a radiating surface adapted to emit LF acoustic energy and a radiating surface opening defined by an outer circumference of the radiating surface; and an LF waveguide defining a first radiation path for the LF acoustic energy, the LF waveguide having a proximal opening positioned adjacent to the LF driver and extending away from the LF driver to a distal opening to define the first radiation path therethough, the proximal opening having a proximal opening area that is smaller than a radiating surface opening area to define a second radiation path for the LF acoustic energy around an outer surface of the LF waveguide, the distal opening of the LF waveguide having a distal opening area that is larger than the radiating surface opening area;

wherein the proximal opening is spaced apart from the LF driver by a distance to define an air gap between the radiating surface of the LF driver and the proximal opening of the LF waveguide; and a high-frequency (HF) driver positioned adjacent to the LF driver, wherein a first distance between an acoustic center of the LF driver and an acoustic center of the HF driver is less than a wavelength at a crossover frequency.

14. The loudspeaker of claim 13, wherein a central radiation axis of the LF driver and a central radiation axis of the HF driver are at offset angles.

15. The loudspeaker of claim 13, wherein the second radiation path exits the speaker enclosure along at least one of a side surface and a rear surface.

16. A loudspeaker comprising:

a low-frequency (LF) driver having a radiating surface adapted to emit LF acoustic energy and a radiating surface opening defined by an outer circumference of the radiating surface; and a high-frequency (HF) driver at least partially obstructing the LF acoustic energy emitted by the LF driver;

wherein a central radiation axis of the LF driver and a central radiation axis of the HF driver are at offset angles and an acoustic center of the HF driver is offset from the central radiation axis of the LF driver, and an LF waveguide defining a first radiation path for the LF acoustic energy, the LF waveguide having a proximal opening positioned adjacent to the LF driver and extending away from the LF driver to a distal opening to define the first radiation path therethrough, the proximal opening having a proximal opening area that is smaller than a radiating surface opening area to define a second radiation path for the LF acoustic energy around an outer surface of the LF waveguide, the distal opening of the LF waveguide having a distal opening area that is larger than the proximal opening area.

17. The loudspeaker of claim 16, wherein the LF waveguide is detached from the LF driver to define an air gap between the radiating surface of the LF driver and the proximal opening of the LF waveguide.

18. The loudspeaker of claim 16, wherein a proximal end of the LF waveguide is not physically connected to the LF driver.

* * * * *